United States Patent [19]

Stone et al.

[11] 4,356,430

[45] Oct. 26, 1982

[54] GYROTRON CAVITY RESONATOR WITH AN IMPROVED VALUE OF Q

[75] Inventors: David S. Stone; James F. Shively, both of Los Altos, Calif.

[73] Assignee: Varian Associates, Inc., Palo Alto, Calif.

[21] Appl. No.: 184,492

[22] Filed: Sep. 5, 1980

[51] Int. Cl.[3] ..... H01J 25/00

[52] U.S. Cl. ..... 315/4; 315/3; 315/5; 333/34; 333/230

[58] Field of Search ..... 315/3, 4, 5; 333/34, 333/230; 330/4.6, 4.7, 43

[56] References Cited

U.S. PATENT DOCUMENTS

| | | | |
|---|---|---|---|
| 2,552,334 | 5/1951 | Linder | 333/230 |
| 2,805,337 | 9/1957 | Dunsmuir | 333/34 X |
| 2,826,713 | 3/1958 | Hernqvist | 333/230 |
| 2,938,179 | 5/1960 | Unger | 333/34 |
| 3,457,450 | 7/1969 | Feinstein et al. | 315/5 |
| 4,224,576 | 9/1980 | Granatstein et al. | 315/5 |

*Primary Examiner*—Saxfield Chatmon, Jr.

*Attorney, Agent, or Firm*—Stanley Z. Cole; Keiichi Nishimura

[57] ABSTRACT

A gyrotron cavity resonator is connected smoothly and directly to an output waveguide with a very gradually tapered wall so that values of external Q lower than twice the diffraction limit are obtainable.

7 Claims, 4 Drawing Figures

GYROTRON CAVITY RESONATOR WITH AN IMPROVED VALUE OF Q

DESCRIPTION

BACKGROUND OF THE INVENTION

The present invention relates to a gyrotron cavity resonator, and particularly, to a scheme for adjusting its external Q value lower than previously believed possible. The word "gyrotron" used herein is to be taken to mean any of the family of devices which rely on the principles of the cyclotron resonance maser such as gyro-traveling wave tubes, gyrotron oscillators, gyroklystron amplifiers, etc.

As described, for example, in the article by A. V. Gapanov et al, Izvestiya Vysshikh Uehebnykh Zavedenii, Radiofizika, Vol. 18, No. 2, 1975, a gyrotron in its most popular configuration is almost completely axisymmetric and comprises an injector including an adiabatic electron gun, a resonator, an output waveguide whose cooled walls act as the electron collector, and a set of solenoids. Its electron-optical system is so arranged as to form a tubular stream of electrons which move in helical trajectories, rotating at the cyclotron frequency. As the electrons move axially into a region of increasing magnetic field, their rotational velocities increase and the energy of electron cyclotron rotation becomes several times the energy of electron axial motion.

The resonator is a fairly long segment of a regular waveguide; its effective length L (or the greatest longitudinal length of magnetic field homogeneity inside the cavity) is generally many times greater than $\lambda$, the free space wavelength of the cavity resonance. It is bounded at the injector end by a constriction through which the electrons enter the resonator and at the opposite end by a transition to the external waveguide. Resonators having simple profiles shown in FIG. 1 have been considered by Gapanov et al and it was reported in the above-cited reference by these authors that the lowest attainable value of Q lies slightly above twice the diffraction limit.

This conclusion presents a critical restriction on gyrotron design because the diffraction limited Q is given by $Q_{diff}=4\pi(L/\lambda)^2$ and when one calculates the Q value desired for maximum gyrotron efficiency it often lies below twice $Q_{diff}$.

SUMMARY OF THE INVENTION

An object of the invention is to provide a gyrotron cavity resonator with improved efficiency. A further object is to provide an output loading scheme which may be used to obtain values of external Q for a gyrotron cavity resonator which lie below twice the diffraction limited value of Q.

These objects have been achieved by making the transition smooth between the resonator and the output waveguide, or more specifically by eliminating a constriction at the junction between the resonator and the output waveguide and by reducing the tapering angle of the inner walls of the output waveguide from the values according to the earlier designs.

DETAILED DESCRIPTION OF THE INVENTION

Figure 1A:
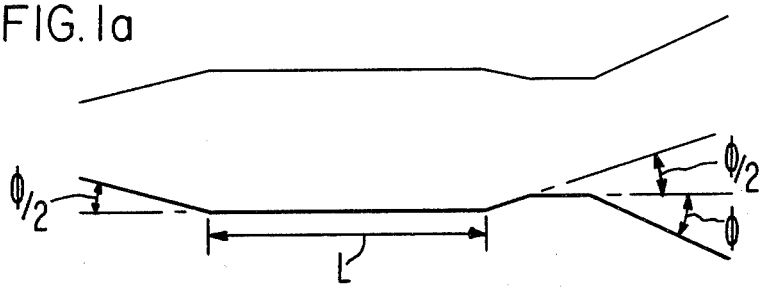
FIGS. 1A and 1B show the resonator profiles which were studied and reported upon by Gapanov et al. in the reference quoted above.
Figure 1B:
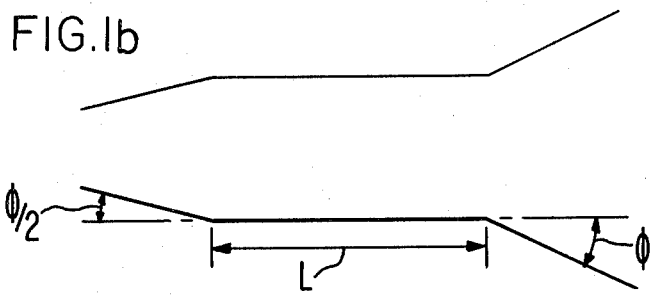
Figure 2:
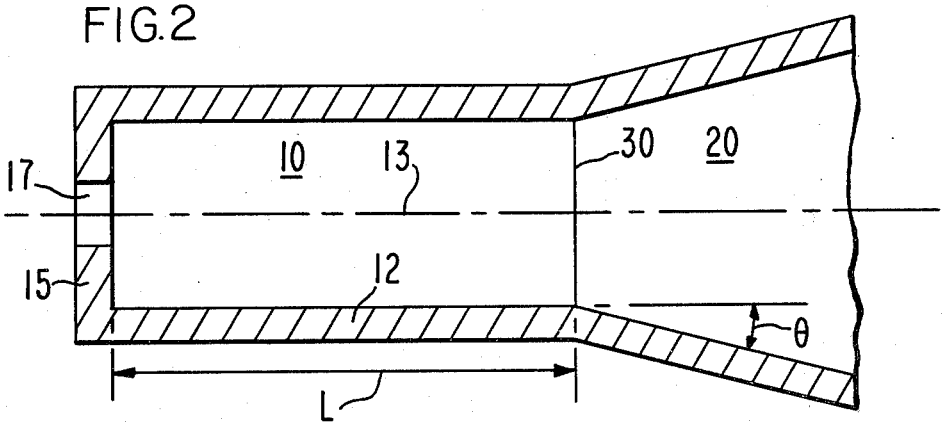
FIG. 2 shows the profile of a gyrotron cavity resonator of the present invention.

Referring now to FIG. 2, there is shown a gyrotron cavity resonator 10 incorporating features of the present invention. More specifically, resonator 10 is shown as an ordinary cylindrical waveguide with inner wall 12 of a uniform circular cross-section and axis of symmetry 13. On one end which may be referred to as the upstream end, resonator 10 is bounded by constriction 15 forming a window 17 for admitting a beam of electrons inside. On the opposite end which may be referred to as the downstream end, resonator 10 connects to and directly opens into output waveguide 20 across junction plane 30 which is perpendicular to axis of symmetry 13. Output waveguide 20 comprises tapered wall 25 which is locally conical in shape with respect to axis 13 at junction 30 and its cross-section increases smoothly in the downstream direction. The contact between resonator 10 and output waveguide 20, or that between inner resonator wall 12 and tapered wall 25 is made quite smooth across junction plane 30 so as, for example, to prevent conversion of the output radiation into unwanted modes. In other words, unlike the designs shown in FIG. 1 (*a*), there is no constriction between resonator 10 and output waveguide 20. The angle between tapered wall 25 and axis 13 at junction plane 30 will be written as $\theta$.

When the combination described above and illustrated in FIG. 2 is used as a component of a gyrotron, an electron injector system comprising a magnetron injection electron gun, for example, is disposed on the upstream side of resonator 10. A system of solenoids creates a magnetic field along the electron path so that the electrons from the injector system enter resonator 10 through window 17 while rotating in helical trajectories and moving generally in the downstream direction along axis 13. On leaving resonator 10, the electrons enter a decreasing magnetic field and reach a collector (not shown) where they are collected. A downstream portion of tapered wall 25 may be used as a collector or output waveguide 20 may be designed as a coupler for bridging resonator 10 and a collector.

Figure 3:
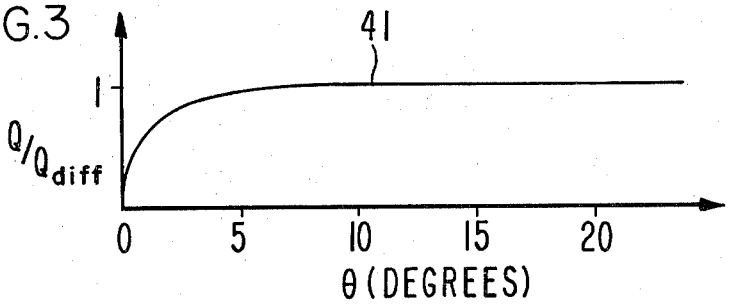
FIG. 3 illustrates typical relationships between Q and the tapering angle of the output waveguide.

The angle $\theta$ defined above is adjusted so as to obtain a desired Q value. Smaller angles $\theta$ generally provide low Q values because the discontinuity in the conducting wall at junction plane 30 then becomes less abrupt. Referring now to FIG. 3 which shows the relationship between $\theta$ and Q of resonators of the type illustrated in FIG. 2, the ordinate represents Q in units of $Q_{diff}$ and the abscissa represents angle $\theta$. Curve 41 relates to resonators with $L/\lambda=6.12$, resonating in the $TE_{02}$ circular electric mode. This experimentally obtained curve clearly shows that Q values lower than twice the diffraction limited value are obtainable by making $\theta$ sufficiently small although the critical angle below which $\theta$ must be reduced for this purpose depends on other factors relating to the choice of resonator mode and the shape of any gradual tapers in the inner resonator wall 12. Where L is several wavelengths and the circular electric resonator modes are chosen, however, it seems sufficient if $\theta$ is made smaller than about 10°–15°.

Although the present invention has been described above in terms of a few particular embodiments, this description is not intended to be considered as limiting but merely as illustrative. For example, the cavity resonator-output waveguide combination illustrated in FIG. 2 need not appear as an element of a gyrotron, the cross-section of cavity resonator 10 perpendicular to symmetry axis 13 may be elliptical, rectangular or square rather than circular and the tapered inner wall 25 of output waveguide 20 need not be conical ($\theta$ representing in such cases the discontinuity in slope of the waveguide boundary at junction plane 30). The scope of the invention is defined by the following claims.

We claim:

1. A cavity resonator with a reduced Q value, said resonator having a longitudinal direction and an effective length along said direction, said resonator being connected to and directly opening into an output waveguide across a junction plane which is perpendicular to said direction, each segment of the inner wall of said output waveguide making an angle smaller than 20° with said direction, the Q value of said resonator being smaller than $8\pi(L/\lambda)^2$ where L is said effective length and $\lambda$ is the free-space wavelength of the cavity resonance inside said resonator.

2. The resonator of claim 1 wherein the cross-sectional area of said output waveguide parallel to said junction plane increases monotonically in said longitudinal direction.

3. The resonator of claim 1 wherein said angle is smaller than 10°.

4. The element of claim 1 which is circular in cross-section perpendicular to said longitudinal direction.

5. The element of claim 1 wherein said output waveguide is conical in shape.

6. The resonator of claim 1 which is elliptical in cross-section.

7. The resonator of claim 1 which is a part of a gyrotron.

* * * * *

UNITED STATES PATENT AND TRADEMARK OFFICE

CERTIFICATE OF CORRECTION

PATENT NO. : 4,356,430

DATED : October 26, 1982

INVENTOR(S) : David S. Stone; James F. Shively

It is certified that error appears in the above-identified patent and that said Letters Patent are hereby corrected as shown below:

After Column 1, line 5 insert --The invention described herein was made in the course of Contract No. W-7405-eng-26 with the United States of America as represented by the Department of Energy.--

Signed and Sealed this

*Twelfth* Day of *April 1983*

[SEAL]

*Attest:*

GERALD J. MOSSINGHOFF

*Attesting Officer*

*Commissioner of Patents and Trademarks*